United States Patent [19]

Fouke

[11] Patent Number: 4,670,825

[45] Date of Patent: Jun. 2, 1987

[54] REFLECTOR FOR USE IN UNIFORMLY ILLUMINATING A POLYGONAL AREA

[76] Inventor: Herbert A. Fouke, 868 Jonathan La., Newark, Ohio 43055

[21] Appl. No.: 815,422

[22] Filed: Dec. 31, 1985

[51] Int. Cl.[4] ..... F21V 7/00

[52] U.S. Cl. ..... 362/308; 362/309; 362/302; 362/346; 362/348

[58] Field of Search ..... 362/309, 308, 302, 327, 362/217, 296, 297, 299, 311, 326, 346, 348, 337

[56] References Cited

U.S. PATENT DOCUMENTS 3,502,865 3/1970 Matteson ..... 362/309

3,732,417 5/1973 Nordquist ..... 362/309

4,462,068 7/1984 Shadwick ..... 362/309

*Primary Examiner*—Raymond A. Nelli

*Attorney, Agent, or Firm*—John D. Lister; Cornelius P. Quinn

[57] ABSTRACT

A reflector for obtaining isolux light distribution patterns over polygonal areas is disclosed. The reflector is equipped with a plurality of circumferentially adjacent light transmissive wall sections corresponding in number to the number of corners of the polygonal light pattern. A reflective coating and vertically oriented prisms formed on the outer surface of the wall sections cooperate to reflect and laterally redirect light to provide the desired isolux polygonal light pattern.

10 Claims, 12 Drawing Figures

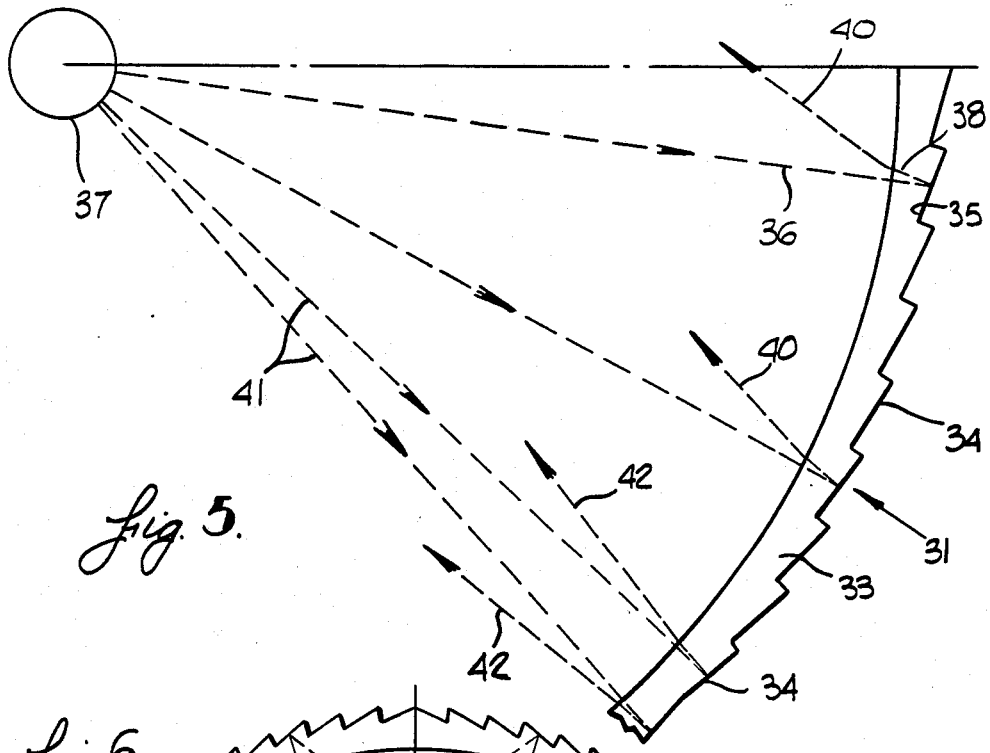
Fig. 5.
Fig. 6.
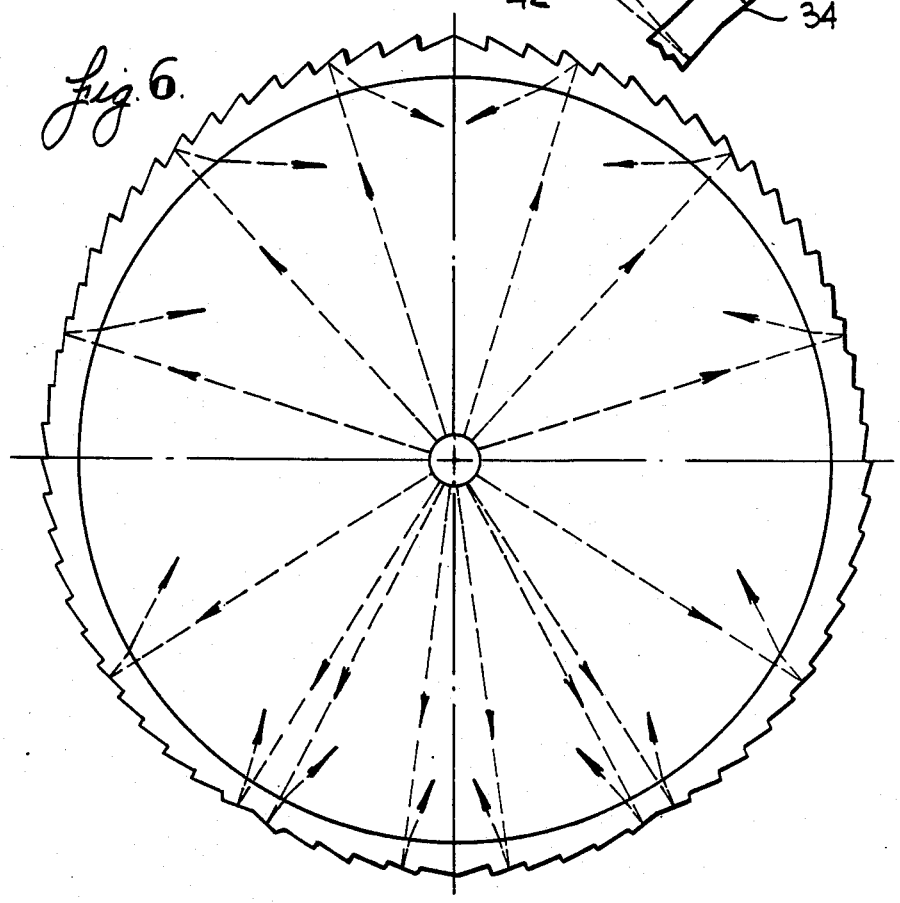

REFLECTOR FOR USE IN UNIFORMLY ILLUMINATING A POLYGONAL AREA

This invention relates to reflectors for obtaining equal light distribution patterns over large quadrilateral and other polygonal areas.

Luminaires having laterally symmetric light distribution have been used to illuminate large outdoor areas, such as parking lots, shopping centers, outdoor work areas, or the like. Such luminaires produce circular light distribution patterns, both in terms of cones of candlepower distribution and in isolux curves, the latter being lines representing equal footcandle illumination levels. However, most areas where such luminaires are used are not circular, but rather square or rectangular in shape, and, therefore, a rectangular or square distribution of light would be more desirable for lighting purposes. Luminaires having a square light pattern provide not only more uniform lighting but require fewer fixtures and poles and less energy consumption. Luminaires with circular patterns require substantial light overlap to achieve a desired minimum light level at the mid-point between poles. This results in wasted energy and increased costs because it takes more fixtures and poles to light a given area. Since the square light pattern minimizes light overlap 25% greater pole spacing may be achieved. Also, 22% increase in an illuminated area may be achieved for a typical four pole arrangement and the increase in illuminated area can become even larger as the number of polse increases. This means that a square light pattern becomes more efficient as the project size increases which translates directly to a substantial energy savings in terms of watts per square foot of illuminated area. However, a basic problem arises in attempting to distribute light from such luminaires in order to illuminate a polygonal area. That is, when light is raised from the normal circular pattern to reach the far corner areas of the square pattern, the candlepower of the raised beam will remain the same but the footcandles of illumination on the corner areas will decrease relative to the delivery at the sides of the pattern. This follows from the fact that the light, when raised, must travel a greater distance at a higher angle before it reaches the corner areas of the pattern. Thus, it is not just a matter of lifting the light at the corner areas to produce a quadrilateral illuminated area. The desired pattern should be isolux, with equal distribution of illumination along the sides of each quadrilateral area from the brightest area beneath the lighting unit to the area of least illumination at the outermost boundaries of the lighted area.

Accordingly, it is an object of this invention to provide a reflector capable of producing a polygonal isolux pattern on a surface to be illuminated.

It is another object of the present invention to provide a luminaire having a reflector which produces a quadrilateral illuminated area which is isolux with equal distribution of illumination along the sides of each quadrilateral area from the brightest area beneath the lighting unit to the area of least illumination at the outermost boundaries of the lighted area.

SUMMARY OF THE INVENTION

The present invention to accomplish these objects may be provided with circumferentially spaced vertical prisms molded on the exterior wall of a transparent reflector with a reflective surface of metallic or other type of coating on the exterior wall of the reflector. The reflective surface and the vertical prisms are oriented in a manner to laterally redirect substantially all of the light incident thereon towards the corners of the quadrilateral area, thereby laterally concentrating the emitted light in the direction of the corners at predetermined angles.

BRIEF DESCRIPTION OF THE DRAWINGS

FIG. 5 is a segment of the horizontal cross-section of the reflector illustrated in FIG. 4.

FIG. 6 is a horizontal cross-section of a reflector in accordance with the present invention that would produce the rectangular isolux illumination pattern C shown in FIG. 1.

DETAILED DESCRIPTION OF THE INVENTION

Figure 1:
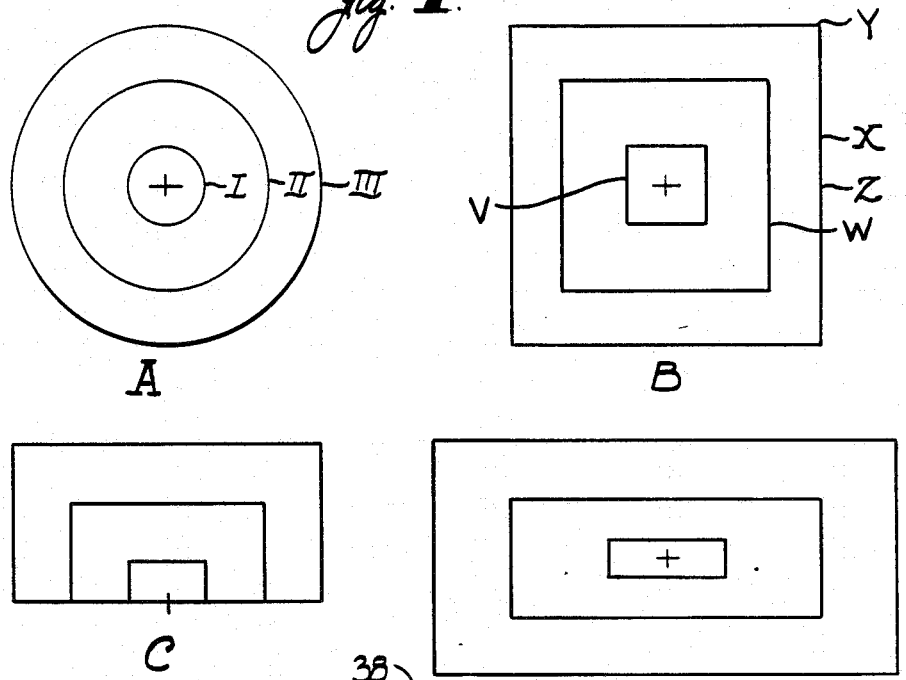
FIG. 1 is a diagrammatic representation of a circular isolux illumination pattern A of the prior art, a square isolux illumination pattern B produced in accordance with the present invention, a rectangular asymmetric isolucx illumination pattern C produced in accordance with the present invention, and a rectangular long and narrow illuminatin pattern D produced in accordance with the present invention.
Figure 2:
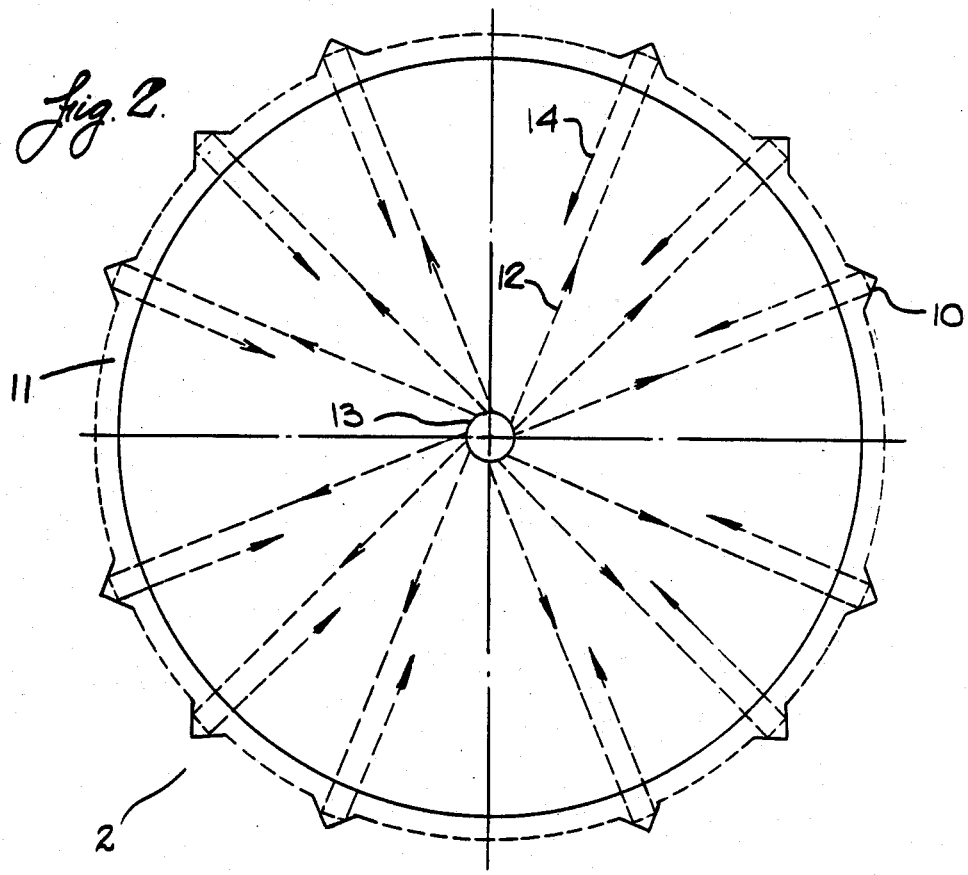
FIG. 2 is a horizontal cross-section of a typical prismatic reflector that would produce the circular isolux illumination pattern A shown in FIG. 1.
Figure 3:
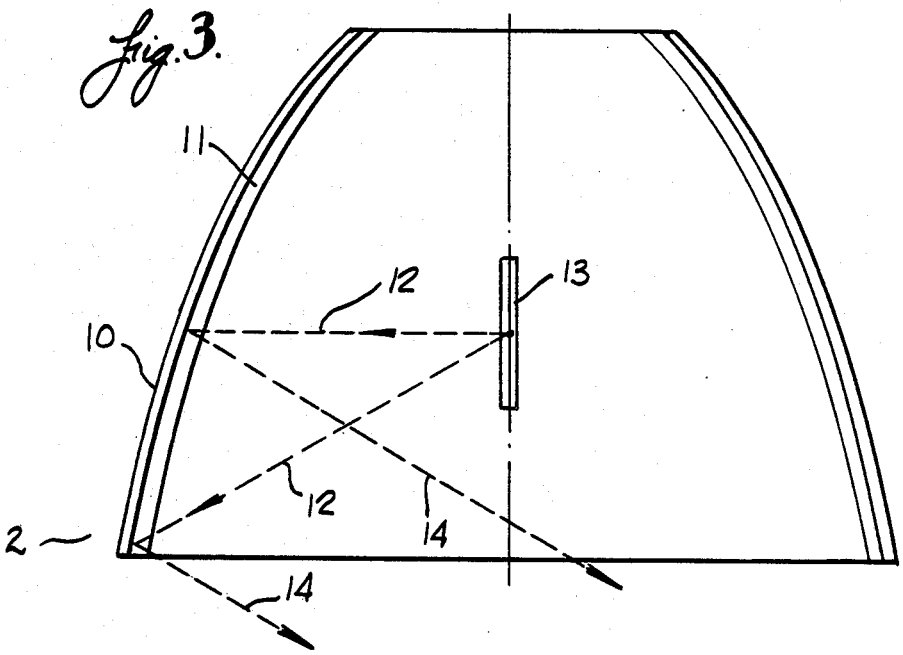
FIG. 3 is a vertical cross-section of the prismatic reflector shown in FIG. 2.

Referring to the drawings, FIGS. 2 and 3 show a typical prismatic reflector of the prior art generally identified by the reference numeral 2 that would produce a circular isolux illumination pattern as shown in A of FIG. 1. A plurality of 90° reflecting prisms 10 spaced circumferentially about the outer wall of a transparent medium 11 reflect light rays 12 emitted from a light source 13, as rays 14. The circular isolux illumination pattern provided by the prior art reflector 2 as shown in A of FIG. 1 has circles I, II and III which are isolux circles tracing the equal illumination or isolux levels. Obviously, as the distance the light has to travel from the light source increases, the illumination intensity of the isolux circle decreases. Thus, the intensity of circle I is greater than the isolux circle II and the illumination intensity along the isolux circle II is greater than that along the isolux circle III. A reflector of this type cannot provide a lateral asymmetric distribution, the type required to produce a square light pattern.

In FIG. B isolux squares V, W and X are produced by a *refractor* according to the present invention. The square distribution bounded by line X differs from the prior art circular distribution bounded by line III by the additional corner areas. To provide a square distribution these areas must also be illuminated. The candlepower required to produce equally intense illumination in a corner of any one of the isolux squares V, W or X, for instance at point Y, and in the middle of the side wall of the same isolux pattern such as point Z, will be unequal. Thus, due to the fact that the light has to travel a greater distance to reach point Y than to reach point Z, and the intensity of light drops proportionally to the second power of the distance it has to travel, more light has to be concentrated towards the corner areas.

Merely raising the light to point Y while continuing to send light from the same vertical section of the reflector to point Z would not provide a square distribution because the footcandle level at point Y must be the same as Z but since it is further away and at a higher angle more light must be sent to Y than to Z.

Figure 4:
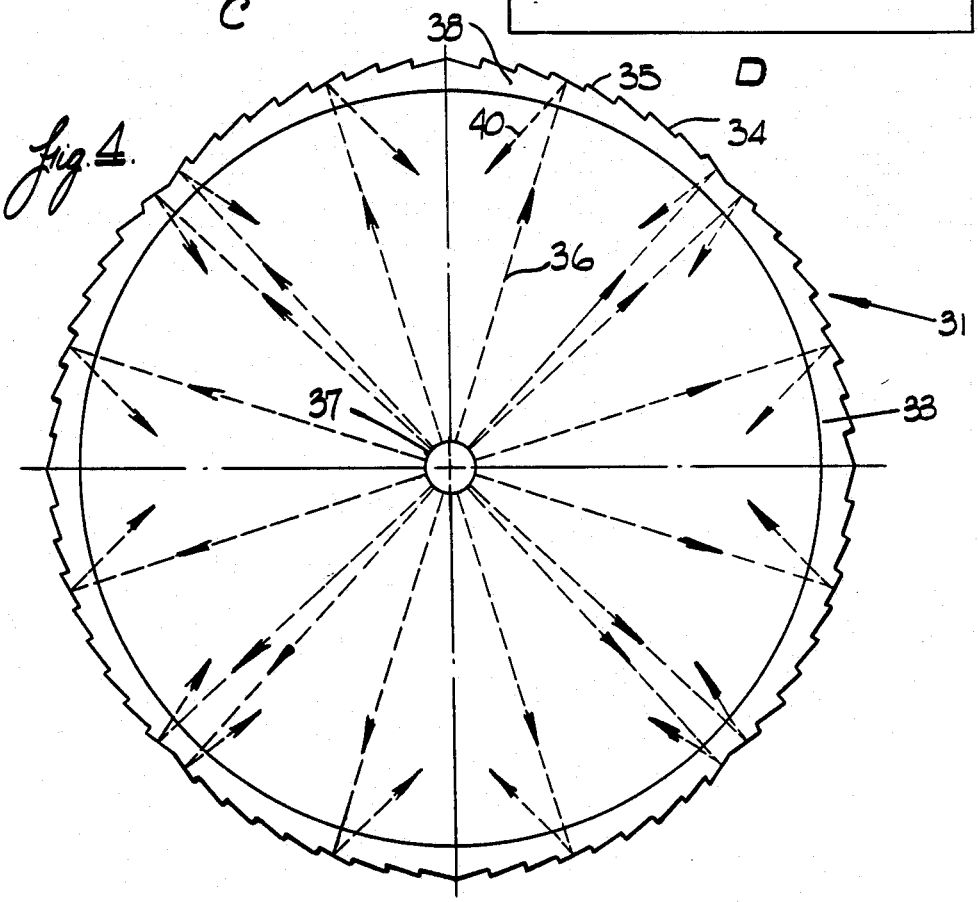
FIG. 4 is a horizontal cross-section of a reflector in accordance with the present invention that would produce the square isolux illumination pattern B shown in FIG. 1.

As shown in FIG. 4 a reflector generally identified by the reference numeral 31 has a transparent median 33 with a reflective coating 34 of metallic or other type of coating formed on its outer surface. A plurality of vertical prisms 35 are molded on the outer surface of the transparent median 33 and positioned circumferentially thereon. The vertical prisms 35 are used to laterally redirect the light rays and provide for concentration of light directed at the diagonals of the square pattern. The reflector 31 is shown divided substantially into four equal areas or sections the center of each section facing a corner of the desired isolux pattern.

As illustrated in FIGS. 4 and 5 light rays 36 emitted from a light source 37 are reflected as rays 38 by the reflective coating 34 on the outer surface of the reflector 31. If the inner and outer surfaces of the transparent median 33 were parallel the reflected ray 38 would be reflected radially toward the light source as with prisms as shown in FIG. 2. Since, however the inner and outer surfaces of the transparent median 33 are not parallel the light rays 36 emitted from the light source 37 are redirected toward the diagonals, thus increasing the intensity of the light being directed toward the corners of the pattern to be lighted. As illustrated in FIG. 5 the light rays 36 from the light source 37, enter reflector 31, strike the surface of the vertical prism 35 at an angle to the normal to this surface and are reflected by the reflective coating 34 at a lateral deviation to the entering rays 36 as rays 38. Since the rays 38 strike the inner surface of reflector 31 at an angle they are refracted and exit as rays 40. An additional benefit derived from this refractive action is that light rays 41 which could be allowed to reflect back parallel to themselves, can be reflected as rays 42 having a small lateral deviation, thus missing the light source 3, and thereby achieving a much longer life for the light source.

If the desired isolux pattern is to be rectangular rather than square, the laterally acting prisms would be arranged within their respective quarter sections to direct the light from the lamp source at more than forty-five degrees to two of the four quarter areas and at correspondingly less than forty-five degrees to the other two quarter areas. In the light of similar considerations, diamond shaped isolux illumination patterns, or polygonal patterns in addition to the four-sided variety may also be produced.

Figure 7:
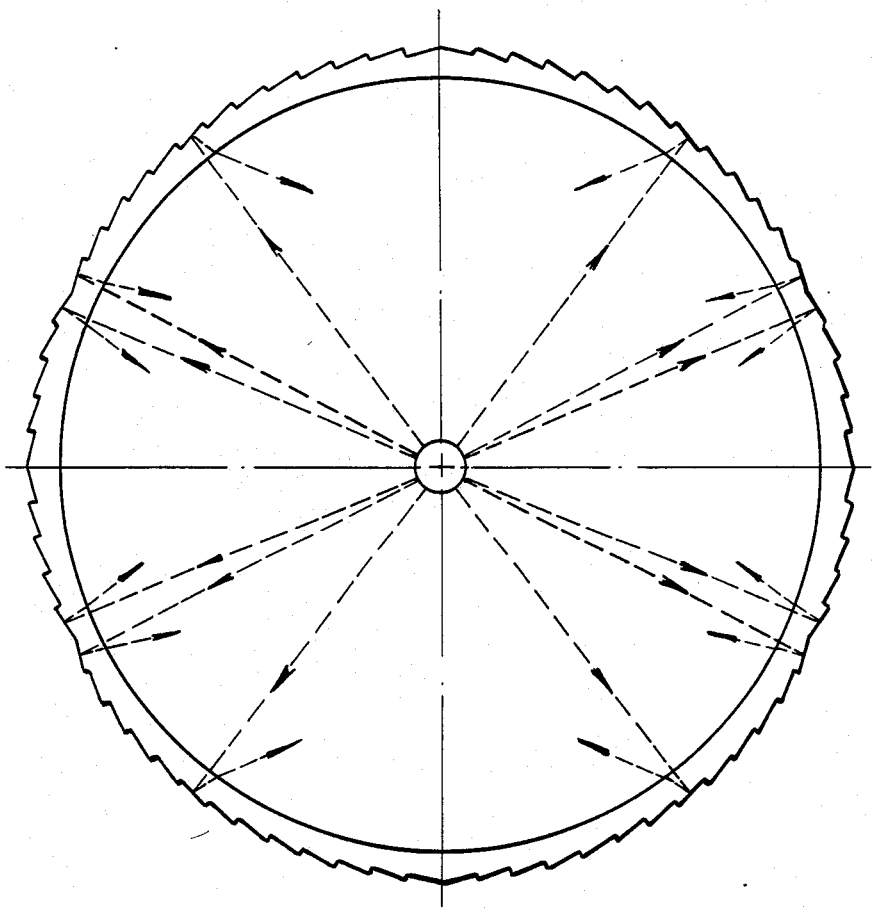
FIG. 7 is a horizontal cross-section of a reflector in accordance with the present invention that would produce the long and narrow isolux illumination pattern D shown in FIG. 1.

For example the reflector illustrated in FIG. 6 would produce the rectangular asymmetric isolux illumination pattern C illustrated in FIG. 1 and the reflector illustrated in FIG. 7 would produce the long and narrow isolux illumination pattern D shown in FIG. 1. In addition it should be understood that various adjustments to the prism angles in these reflectors cannot only produce the sharp cornered isolux illumination patterns but common isolux street lighting distributions as well, such as IES Types I, II, III, IV, Type I 4 way and Type II 4 way.

Figure 8:
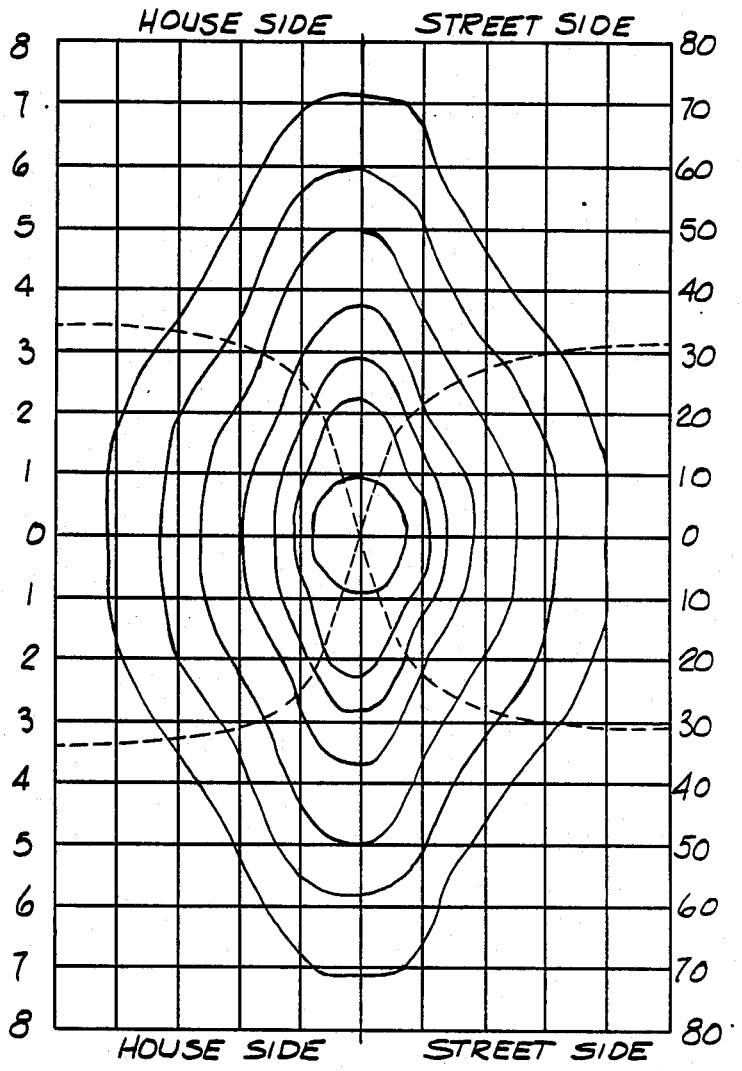
FIG. 8 is a diagrammatic representation of an IES Type I isolux pattern.
Figure 9:
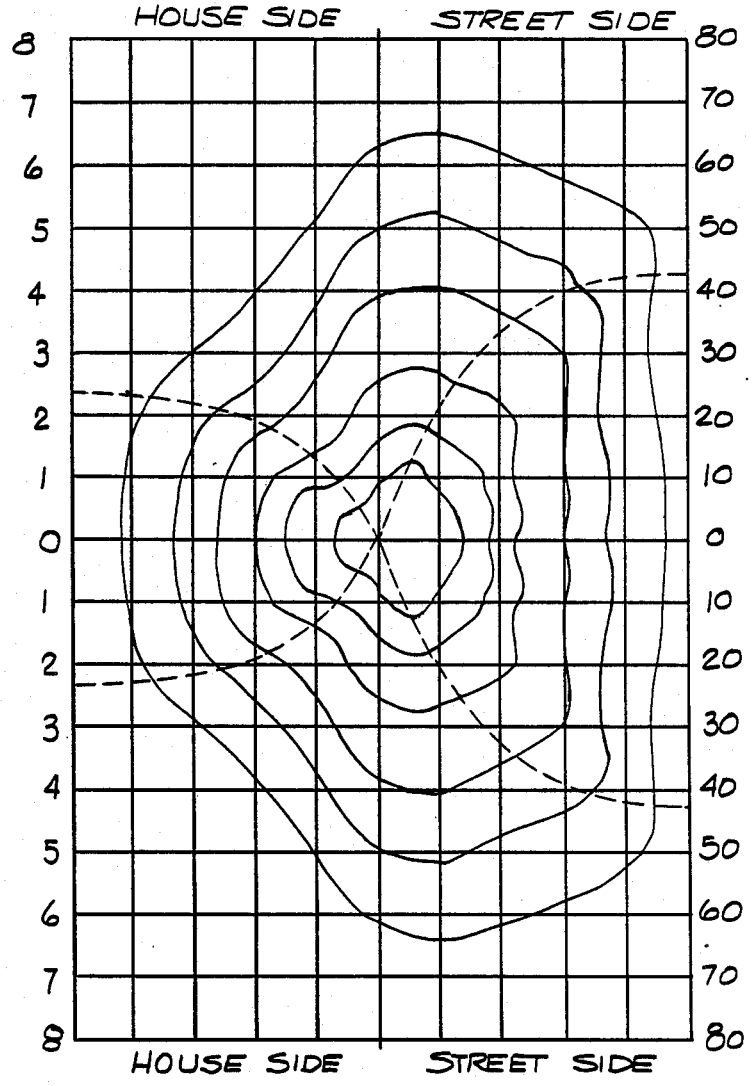
FIG. 9 is a diagrammatic representation of an IES Type IV isolux pattern.

Typical Type I and Type IV isolux illumination patterns are shown in FIGS. 8 and 9.

While the invention has been particularly shown and described in reference to a preferred embodiment thereof, it will be understood by those skilled in the art that various changes in form and details may be made therein without departing from the spirit and scope of the invention.

What is claimed is:

1. A reflector for use with a light source and including means for distributing light emitted from a light source into a polygonal isolux light pattern upon an area below said reflector, said distributing means comprising light transmissive wall means for receiving the emitted light, said wall means including a plurality of circumferentially adjacent sections having vertically oriented prisms formed thereon, the number of said sections corresponding to the number of corners of the polygonal light pattern, said vertically oriented prisms of each said section having surfaces each of which comprise means for laterally redirecting the emitted light rays impinging thereon and concentrating them at the corners of the polygonal light patterns.

2. A reflector as defined in claim 1 wherein said light transmission wall means has an outer surface and said vertically oriented prisms are on the outer surface of said light transmissive wall means.

3. A reflector as defined in claim 2 wherein a reflective coating is provided on the outer surface of said light transmissive wall means and said vertically oriented prisms to reflect light emitted from said light source.

4. A reflector as defined in claim 3 wherein said polygonal light pattern is isolux in the form of a square.

5. A reflector as defined in claim 3 wherein said polygonal light pattern is an isolux in the form of a rectangle.

6. A reflector as defined in claim 3 wherein said polygonal light pattern is an isolux in the form of an asymmetric retangle.

7. A reflector for use with a light source and including means for distributing light emitted from a light source into a polygonal isolux light pattern said distributing means comprising light transmissive wall means, a reflective surface and a number of vertically oriented prisms formed on an outer surface of said wall means for reflecting and redirecting the light emitted from the light source.

8. A reflector as defined in claim 7 wherein said light transmissive wall means includes plastic.

9. A reflector as defined in claim 7 wherein said light transmissive wall means includes glass.

10. A reflector as defined in claim 7 wherein said reflective coating is selected from a group consisting of aluminum, silver, chromium, platinum and/or nickel.

* * * * *